United States Patent [19]

Ostapovitch

[11] 4,070,557

[45] Jan. 24, 1978

[54] APPARATUS FOR PROVIDING CLOSED LOOP CONDITIONS IN VACANT MODULE POSITIONS

[75] Inventor: Harold Joseph Ostapovitch, Lachine, Canada

[73] Assignee: Northern Telecom Limited, Montreal, Canada

[21] Appl. No.: 708,626

[22] Filed: July 26, 1976

[51] Int. Cl.[2] ..... H01R 13/70

[52] U.S. Cl. ..... 200/51.1; 361/413; 339/19

[58] Field of Search ..... 200/51.1, 51.12, 153 W, 200/2 R; 339/176 MP, 19; 361/413, 415

[56] References Cited

U.S. PATENT DOCUMENTS

| | | | |
|---|---|---|---|
| 1,825,208 | 9/1931 | Rumble | 200/51.1 |
| 2,312,002 | 2/1943 | Schmitt | 200/51.1 |
| 2,908,775 | 10/1959 | Gilbert | 200/51.12 |
| 3,692,966 | 9/1972 | Lancaster | 200/51.1 |
| 3,903,385 | 9/1975 | Moyer et al. | 200/51.1 |

*Primary Examiner*—David Smith, Jr.
*Attorney, Agent, or Firm*—Sidney T. Jelly

[57] ABSTRACT

To provide for closed loop conditions in vacant module positions, as in back panel systems in telecommunications systems, a bridging contact is provided which, in the absence of a module, contacts at least two terminals or contact members. The bridging contact is mounted in the shroud of a back panel. Insertion of a module moves the bridging contact away from contact members. The contact member is given a particular form or shape so that the module does not touch those parts of the bridging contact which actually contact the contact members, giving long serviceability and avoiding damage to the contacting areas.

8 Claims, 12 Drawing Figures

APPARATUS FOR PROVIDING CLOSED LOOP CONDITIONS IN VACANT MODULE POSITIONS

This invention relates to providing closed loop conditions in vacant module positions, for example as in back panel systems in telecommunication systems and similar arrangements.

When a module, or card, is removed from its position in a back panel system, open line conditions occur. By the present invention, a closed loop condition can be provided. Thus a "busy" signal is artifically produced, which facility can be useful, or necessary, for automatic switching systems. The invention can also be applied to connectorized cable designs to provide closed loop conditions when cables are disconnected.

The closed loop connection is provided by a bridging contact in the shroud mounted on the back panel of the frame. In one condition, with the card or module removed, the bridging contact contacts at least two contact members. When a card or module is inserted the bridging contact is moved away from the contact members. To provide for long serviceability it is arranged, as a feature of the invention, that the card or module does not touch those parts of the bridging contact which contact the contact members. Damage to the contact surfaces of the bridging contact is avoided.

The invention will be readily understood by the following description of certain embodiments, by way of example, in conjunction with the accompanying drawings, in which.

Figure 1:
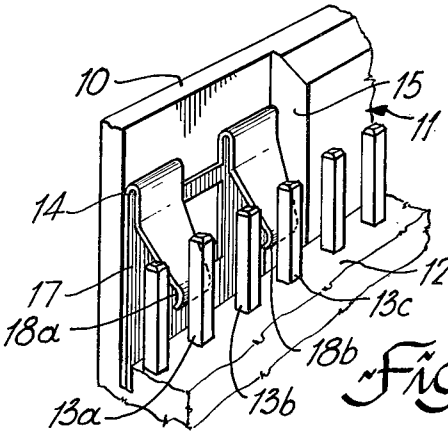
FIG. 1 is a perspective view on the inside of one wall of a shroud.

Illustrated in FIG. 1 is part of the inner side of a wall 10 of a shroud, indicated generally at 11. A number of shrouds are attached to the back panel of a frame and terminals, such as wire wrap terminals, are inserted from the rear through what is conveniently referred to as the base of the shroud. Modules or cards are inserted from the front of the panel, an edge of the card or module entering the shroud and having apertures therein for reception of the inner ends of the terminals. As seen in FIG. 1, the base of the shroud is indicated at 12 and three terminals are indicated at 13*a*, 13*b* and 13*c*.

As previously stated, removal of a card results in open loop conditions. This can be undesirable in some instances. To provide a closed loop condition, when a card is removed, a bridging contact member 14 is inserted in a recess 15 in the wall 10. The bridging contact member 14, in FIG. 1, is bridging terminals 13*a* and 13*c*. Other bridging configurations can be provided.

Figure 2:
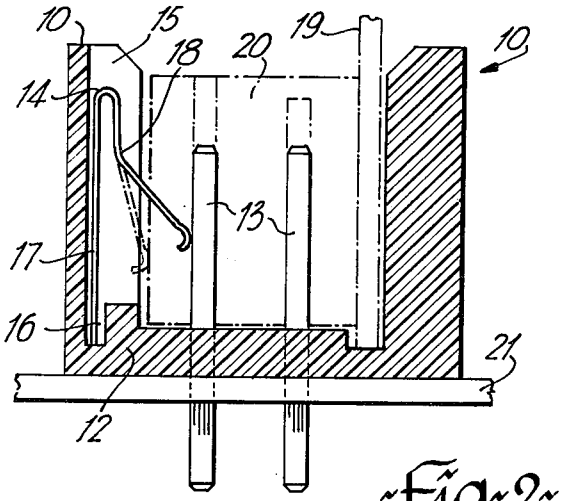
FIG. 2 is a transverse cross-section through a shroud.

The positioning of the bridging contact member 14 is seen in FIG. 2, which is a transverse cross-section. A slot 16 extends from the base of the recess 15 and the back portion 17 of the bridging contact member 14 extends down into this slot. The forward part 18 of the bridging contact member 14 is bifurcated in the example illustrated to form two contact portions 18*a* and 18*b*, which extend into the main portion of the shroud. As seen in FIGS. 1 and 2, when the card is withdrawn the contact portions 18*a* and 18*b* each contact a terminal 13. In FIG. 2, a card 19 is indicated in dotted outline and it will be seen that the contact portion 18*a* and 18*b* of the bridging contact member 14 are pushed back by the connector block 20 on the edge of the card 19. The terminals 13 are fixed in a printed circuit board 21.

Figure 3:
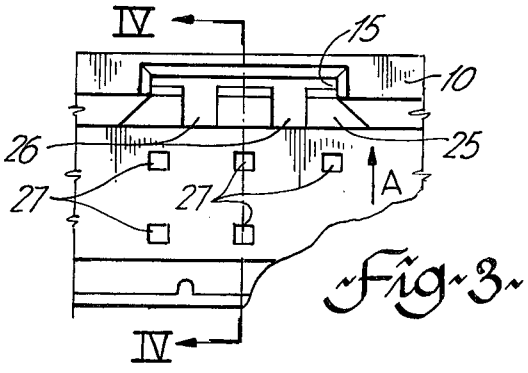
FIG. 3 is a top plan view of one form of shroud.
Figure 5:
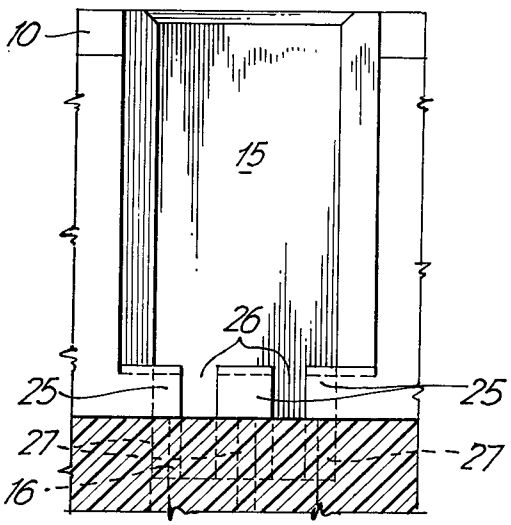
FIG. 5 is a front view in the inner face of a wall of the shroud, as indicated by the arrow A in FIG. 3.
Figure 4:
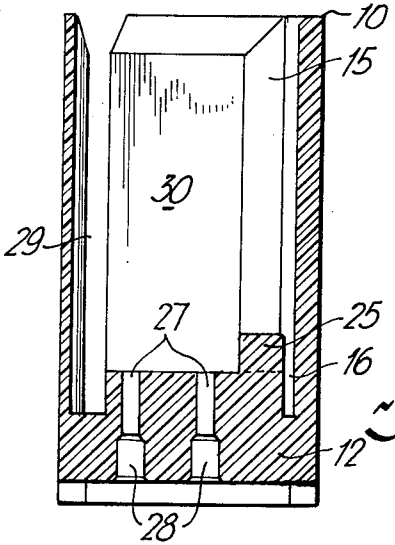
FIG. 4 is a cross-section on the line IV—V of FIG. 3.

FIGS. 3, 4 and 5 illustrate the form of the recess 15 in the wall 16 of the shroud. The recess extends substantially the height of the wall, a low ridge or rib 25 being left at the bottom of the wall. Two slots 26 are formed in the ridge 25 for acceptance of dimples formed on the bridging contact member 14, as will be described. As previously stated, a slot 16 continues from the bottom of the recess 15. Two rows of holes 27 are formed in the base 12 of the shroud for reception of terminals, for example terminals 13 of FIGS. 1 and 2. The holes 27 are enlarged, at 28, toward the base surface of the shroud to assist in entry of the terminals. A slot 29 formed in each end wall 30 of the shroud provides guidance for the card 19 in FIG. 2.

Figure 6:
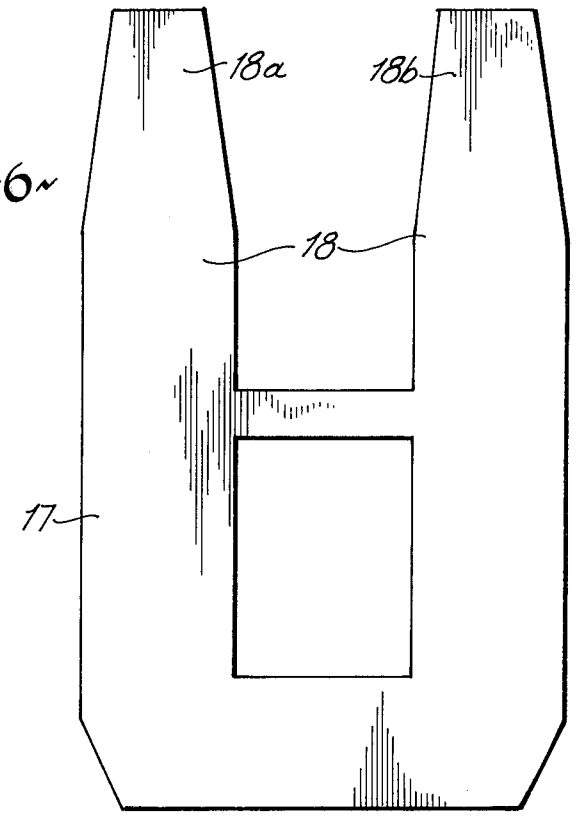
FIG. 6 is a plan view of a blank for one form of bridging contact.
Figure 7:
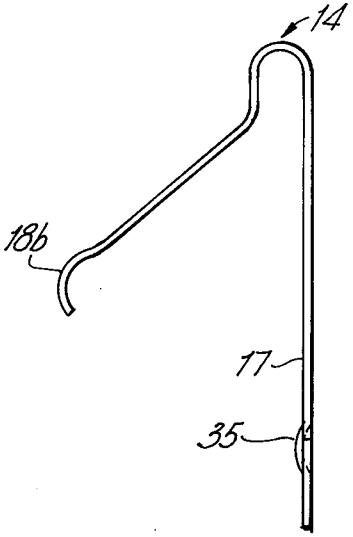
FIGS. 7, 8 and 9 are side view, front view and top view respectively of the form of bridging contact produced from the blank of FIG. 6.
Figure 9:
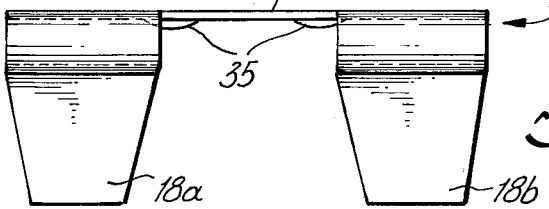
Figure 8:
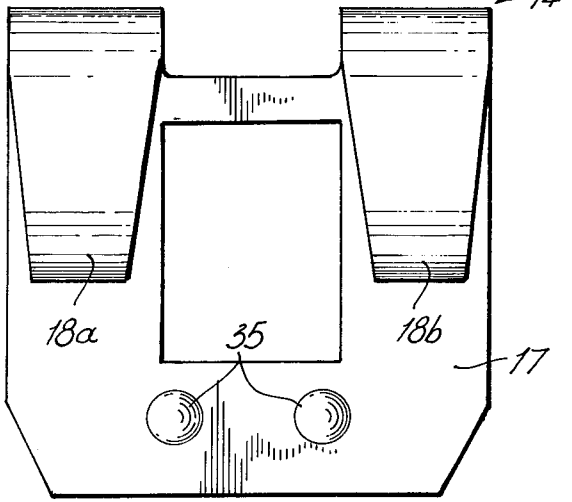

FIG. 6 illustrates one form of blank, as for the bridging contact member 14 in FIGS. 1 and 2 and also as illustrated in FIGS. 7, 8 and 9. The back portion 17 is shown and the contact portions 18*a* and 18*b*.

The bridging contact member 14 is shown formed in FIGS. 7, 8 and 9. The bifurcated portion is bent over, initially by about 180°, but is then bent outwards away from the back portion 17. The ends of the bifurcated portion are bent into arcuate form to provide contact portions 18*a* and 18*b*. This is seen clearly in FIG. 7, a side view. Two dimples 35 are formed in the lower part of the back portion 17, the dimples extending forward, in the same direction as the bifurcated portion, and are positioned to enter the slots 26 in ridge 25 at the base of the recess 15 (FIGS. 3, 4 and 5). The dimples assist in retaining the bridging contact member 14 in the recess 15 and slot 16.

The shaping of the contact portions 18*a* and 18*b* has been made so as to prevent that part of the contact surface which contacts terminals 13 from being contacted by the card edge connector block or housing 20 when a card is inserted. This ensures consistently effective contact between terminals 13 and contact portions 18*a* and 18*b*, regardless of the number of insertions and withdrawals of cards.

Figure 11:
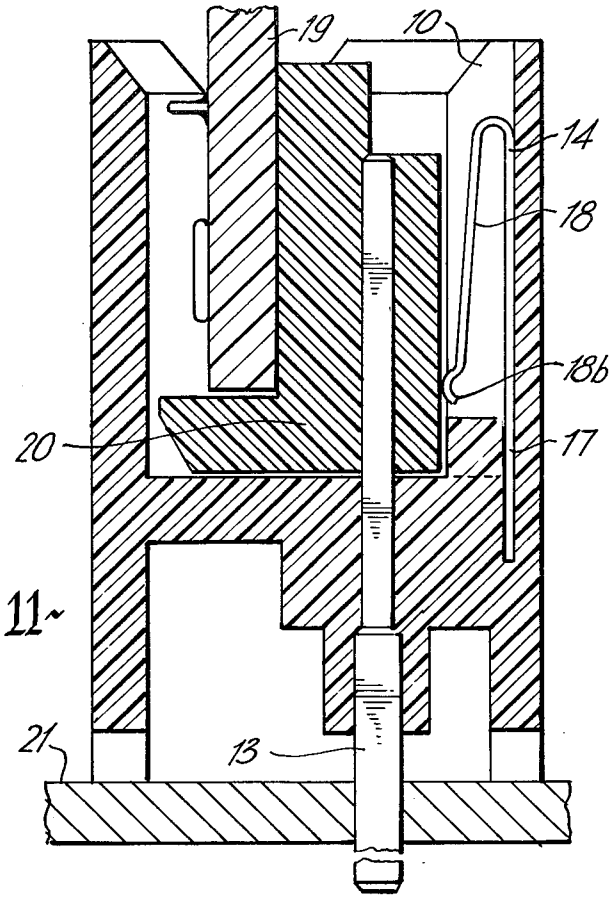
FIG. 11 is a cross-section as in FIG. 10, but with the card or module inserted.
Figure 10:
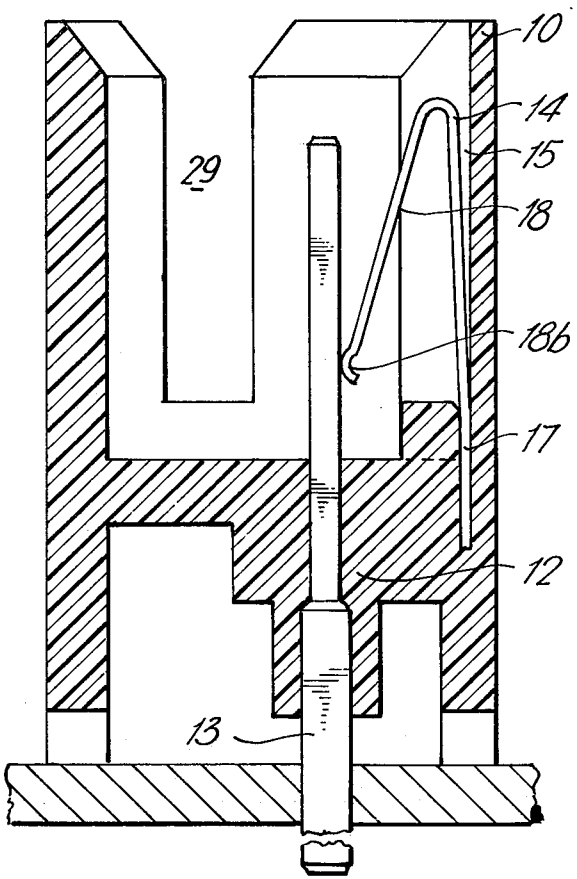
FIG. 10 is a transverse cross-section of another form of shroud, with a bridging contact in place and card or module removed.

FIGS. 10 and 11 are similar transverse cross-sections through a shroud, no card inserted in FIG. 10, and the bridging contact member 14 in contact with the terminals 13. In FIG. 11 a card 19 is inserted and the contact portions of 18*a* and 18*b* have been pushed back by the connector block 20. FIGS. 10 and 11 show one row of terminals 13, while in FIGS. 2, 3, 4 and 5 two rows are provided for.

Figure 12:
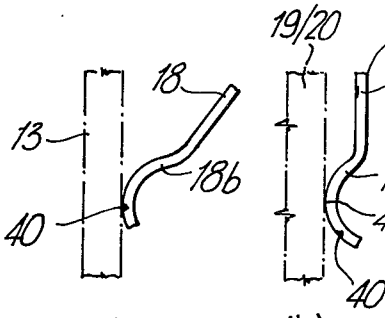
FIG. 12 is an enlarged side view of a contact portion of a bridging contact member.

FIG. 12*a* and 12*b* are enlarged side views of a contact portion, 18*b*. As previously stated, it is a feature of the present invention that the contact portions of the contact bridging member 14 are shaped to maintain an undamaged contact surface regardless of insertion and withdrawal of cards. FIGS. 12*a* and 12*b* illustrate a contact portion 18*b* in the two alternate positions — FIG. 12*a* when no card is inserted and FIG. 12*b* when a card is inserted. Considering first FIG. 12*a*, contact with a terminal 13 indicated in dotted outline, will occur towards the end of the arcuate contact portion — indicated at 40. When a card is inserted, initial contact between the edge of the card and the contact bridging member will occur well away from the arcuate contact portion 18*b*, for example at 41 in FIG. 12*b*. As the card is inserted it pushes the contact portion back, contact between the card edge and bridging member moving downwards. This pushes the front portion 18 of the contact bridging member back. The front portion 18 pivots about the top of the member and thus the contact portion 18*b* swings down and round. The contact position between card edge and contact bridging member continues to move down and eventually moves onto the contact portion 18*b*. However by this time, due to the pivotting of the front portion 18, the contact area 40 is now facing somewhat downwards, as indicated in FIG. 12*b*. Contact between the card and the contact portion occurs at a position spaced from area 40 — example at a position indicated at 42 in FIG. 12*b*. A card 19/20 is indicated by a dotted outline in FIG. 12*b*.

Thus there is no likelihood of damage to the contact area 40 by scratching or other action by the card on the contact area 40. Good contact forces are provided and a wiping action occurs on contact between terminals 13 and contact portions 18*a* and 18*b*.

What is claimed is:

1. Apparatus for providing closed loop conditions in a vacant module position, comprising:

a housing forming a shroud for a back panel and including a base portion, a first wall extending at one side of said base portion and normal thereto, and a further wall extending from said base portion and spaced from and parallel to said first wall;

a plurality of terminals extending through said base portion, said terminals positioned between said walls and including portions extending external to said shroud, in a direction opposite to said walls, for insertion through said back panel for attachment of conductors thereto; and a spring contact member mounted on said first wall and moveable from a first position to a second position, said contact member in said first position in electrical contact with at least two of said terminals and in said second position deflected away from said terminals on insertion of a circuit module into said housing over said terminals, said spring contact member in said first position on absence of said circuit module.

2. Apparatus as claimed in claim 1, said spring contact member mounted in a recess in said wall.

3. Apparatus as claimed in claim 2, including a slot extending in said wall, from said recess, at least towards said base portion, said spring contact member comprising a back portion in contact with a back wall of said recess and extending into said slot, and a front portion for contacting said terminals.

4. Apparatus as claimed in claim 3, said spring contact member of U-shaped cross-section and a plane normal to said back portion, said back portion extending from the bend of said U-shape against said back wall into said slot, said front portion extending from said bend toward said base portion of said housing.

5. Apparatus as claimed in claim 3, said front portion bifurcated, to provide two spaced apart contact portions for contact with two spaced apart terminals.

6. Apparatus as claimed in claim 3, including further slots extending through said wall into said slot extending from said recess, and dimpled formations on said back portion of said spring contact member extending into said further slots to assist in retaining said spring contact member in said recess and said slot.

7. Apparatus as claimed in claim 4, said front portion of said spring contact member including a convex arcuate contact portion at an end of said front portion remote from said bend, said contact portion including first contact areas adjacent the end of the first portion for contacting said terminals and second contact areas spaced from said first contact areas towards said bend for contacting said circuit module, said front portion inclined from said bend to extend inwardly of said housing in a direction away from said wall when said circuit module is absent, the arrangement such that on insertion of said circuit module, said circuit module moves in contact with said inclined front portion and into contact with said second contact areas, said first contact areas moved out of a contact position for contacting said circuit module.

8. Apparatus as claimed in claim 1, said housing further including end walls, and a slot in each end wall for guiding said circuit module into said shroud.

* * * * *